US006691320B2

(12) United States Patent
Smith

(10) Patent No.: US 6,691,320 B2
(45) Date of Patent: Feb. 17, 2004

(54) NECKTIE PROTECTOR

(76) Inventor: Kevin L. Smith, 140 Wynchase La., Fayetteville, GA (US) 30215

( * ) Notice: Subject to any disclaimer, the term of this patent is extended or adjusted under 35 U.S.C. 154(b) by 67 days.

(21) Appl. No.: 09/995,169

(22) Filed: Nov. 26, 2001

(65) Prior Publication Data

US 2003/0097703 A1 May 29, 2003

(51) Int. Cl.[7] ..... A41D 25/04
(52) U.S. Cl. ..... 2/145; 2/46; 24/49.1
(58) Field of Search ..... 2/144, 46, 145–151, 2/155–156, 159, 162, 59, 60, 123, 129, 139, 140, 141.1, 202, 209.11, 183, 171.4, 49.1, 50, 52, 916; 24/49.1, 50, 56, 61, 65

(56) References Cited

U.S. PATENT DOCUMENTS 1,484,354 A * 2/1924 Mclean ..... 24/56
2,423,581 A * 7/1947 Clark ..... 2/48
2,747,192 A 5/1956 Katz
3,618,138 A 11/1971 Retzkin
3,714,669 A 2/1973 Vorbau
3,833,937 A 9/1974 Taylor
4,453,273 A 6/1984 Gerrick
4,716,595 A 1/1988 Camphous
4,888,827 A 12/1989 Lee
4,993,128 A * 2/1991 Gold ..... 24/715.3
5,303,427 A * 4/1994 Fishbaine ..... 2/209.11
6,345,395 B1 * 2/2002 Chilton ..... 2/183

FOREIGN PATENT DOCUMENTS

JP 10147386 * 6/1998 ..... B65D/85/18

* cited by examiner

*Primary Examiner*—Tejash Patel
(74) *Attorney, Agent, or Firm*—Hinkle & O'Bradovich, LLC

(57) ABSTRACT

A necktie protection apparatus is disclosed. The apparatus typically includes an elongated body, which is typically clear flexible plastic, into which the tie can be placed for protection from soiling. The apparatus further includes a drawstring that can be drawn to secure the apparatus over the tie. The apparatus can further include a hook that can attach the apparatus to a button or collar of the wearers shirt.

17 Claims, 2 Drawing Sheets

NECKTIE PROTECTOR

BACKGROUND OF THE INVENTION

1. Field of the Invention

The present invention relates generally to the field of apparel, and more particularly to a necktie apparatus.

2. Description of the Related Art

Neckties are a common part of both casual and business attire. Neckties are typically exposed to various mishaps that can soil the necktie. For example, during dining activities, food and drink can be spilled on the necktie, thereby staining the necktie. The wearer therefore must remove the necktie, inefficiently clean the tie, possible damaging the tie, or spend the remainder of the day with a soiled necktie.

SUMMARY OF THE INVENTION

In accordance with the present invention and the contemplated problems which have and continue to exist in this field, the invention features a necktie protector that can be placed over the necktie and secured, thereby protecting the necktie from staining.

In general, in one aspect, the invention features an apparatus, including an elongated hollow body having an open end and a closed end and a drawstring connected to the body at the open end and along the perimeter of the open end, wherein the drawstring is adapted to adjust the size of the opening.

In one implementation, the apparatus further includes a second hollow body connected to the perimeter of the open end and enclosing a length of the drawstring.

In another implementation, the apparatus further includes an opening in the second hollow body from which the ends of the drawstring protrude.

In another implementation, the second hollow body is integral with the elongated hollow body.

In another implementation, the closed end of the elongated hollow body tapers to a point.

In another implementation, the apparatus includes a hook connected to the apparatus.

In another implementation, the hook is connected to the second hollow body near the opening on the perimeter.

In another implementation, the hook is connected to the second hollow body at a position along the perimeter farthest from the opening.

In still another implementation, the hook is adapted to connect to a shirt.

In yet another implementation, the hook is adapted to connect to a button.

In another implementation, the hook is adapted to connect to a collar.

In another implementation, the elongated hollow body is clear flexible plastic.

In another implementation, the elongated body is cloth.

In another aspect, the invention features a clothing system, including a necktie, a necktie protection apparatus, including an elongated hollow body having an open end and a closed end, a drawstring connected to the body at the open end and along the perimeter of the open end, wherein the drawstring is adapted to adjust the size of the opening, a second hollow body connected to the perimeter of the open end and enclosing a length of the drawstring and an opening in the second hollow body from which the ends of the drawstring protrude.

In one implementation, the system includes a hook connected to the necktie protection apparatus, the hook adapted to connect to a shirt.

In another implementation, the hook is adapted to connect to a shirt button.

In another implementation, the hook is adapted to connect to a shirt collar.

In another implementation, the necktie protection apparatus is clear plastic.

In another implementation, the necktie protection apparatus is disposable.

In another aspect, the invention features a necktie protection apparatus, including an elongated body having an open end and closed end and adapted to enclose a necktie, means to close the open end around the necktie and means to secure the apparatus to the tie.

One advantage of the invention is that it prevents staining of neckties.

Another advantage is that the invention is aesthetically pleasing.

Another advantage is that the invention allows the tie to lay flat within it and it does not crease or wrinkle the tie during operation.

Another advantage of the invention is that it accommodates any style and size of tie.

Another advantage is that the invention allows the design of the tie to be viewed.

Another advantage is that the cost of dry cleaning bills can be reduced.

Other objects, advantages and capabilities of the invention will become apparent from the following description taken in conjunction with the accompanying drawings showing the preferred embodiment of the invention.

DETAILED DESCRIPTION OF THE INVENTION

Figure 1:
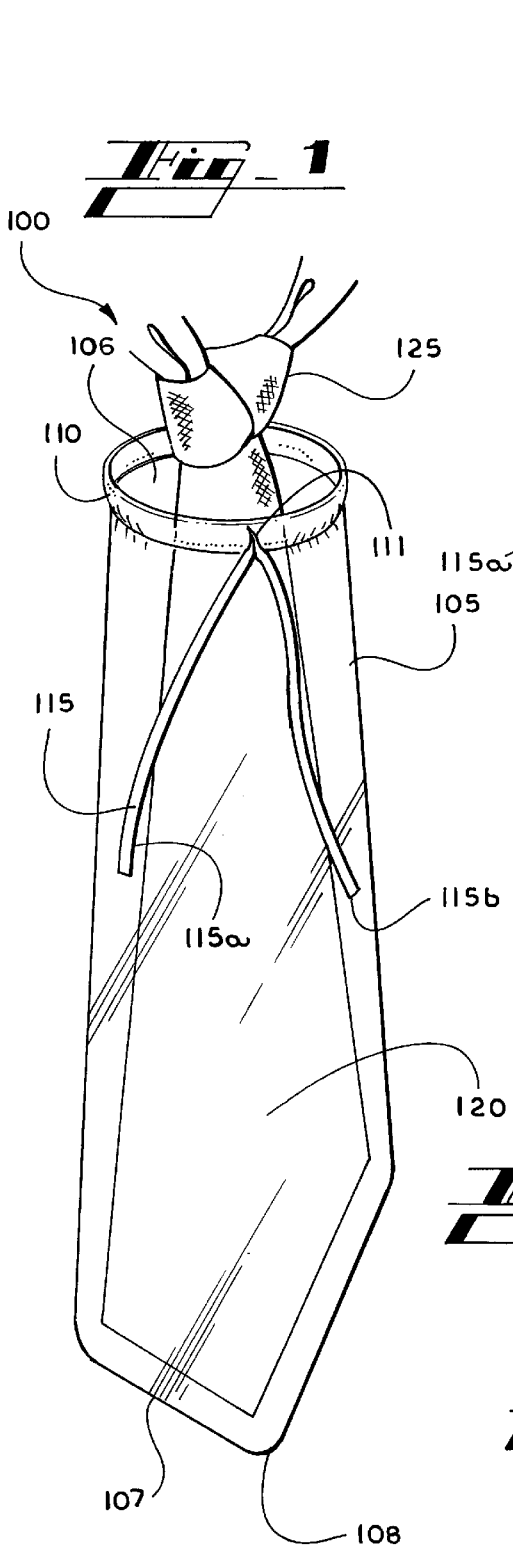
FIG. 1 illustrates a view an embodiment of a necktie apparatus covering a necktie.

Referring to the drawings wherein like reference numerals designate corresponding parts throughout the several figures, reference is made first to FIG. 1.

Necktie Protection Apparatus

FIG. 1 illustrates a view an embodiment of a necktie protection apparatus 100 covering a necktie 120. The apparatus 100 typically includes an elongated hollow body 105 with an open end 106 and a closed end 107. The apparatus 100 includes a second hollow body 110 connected to the perimeter of the open end 106 of the hollow body 105. The second hollow body 110 is typically completely closed for the exception of a small opening 111. The apparatus 100 further includes a drawstring 115 enclosed within the second hollow body 110. The drawstring 115 has two ends 115*a*, 115*b* which protrude from the opening 111. The drawstring 115 allows the open end 106 to be adjustable to any type of tie 120 and tie knot 125. It is understood that the drawstring 115 can be any type of material such as plastic, string, rope, ribbon and the like. There is no limitation to the material used for the drawstring 115. The opening 111 is shown near the back of the tie 120 as indicated by the backside of the knot 125 of the tie 120. The opening 111 can be located at any position as desired by the wearer.

The elongated hollow body 105 is generally tubular having an entirely enclosed hollow interior but for the open end 106, which is generally defined by a perimeter. The second hollow body 110 is also generally tubular having an entirely enclosed interior but for the opening 111.

In one embodiment, the hollow body 105 can be made of clear plastic. The plastic material is typically a flexible material that can be easily folded or "balled up" so that the wearer can easily store the apparatus. In another embodiment, the body 105 can be other types of materials such as opaque plastic or cloth. The body 105 can also include any designs or patterns.

The closed end 107 of the body 105 typically angles to a point 108 so that the overall shape of the body 105 is that of a typical necktie. The shapes and widths of neckties vary greatly with changes in style. Therefore it is understood that there are no definite dimensions for the body 105.

In one embodiment, the second hollow body 110 is an integral part of the body 105. For example, the open end 106 of the body 105 can be folded over and stitched or otherwise connected, thereby forming the hollow body 110. In another embodiment, the second body 110 can be a separate body that is connected to the body 105.

Necktie Protection Apparatus Operation

Figure 2:
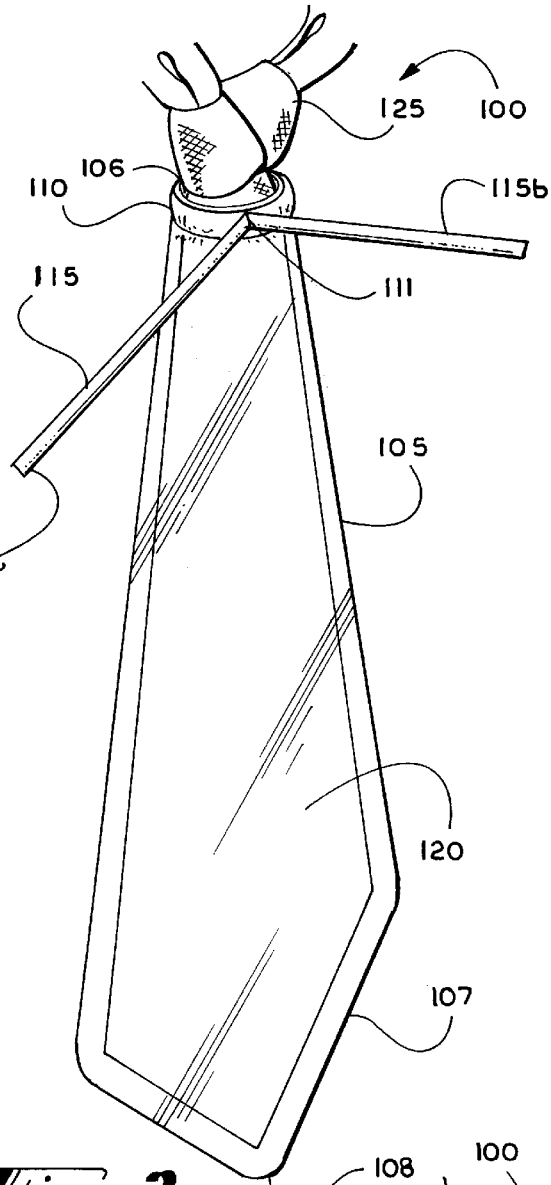
FIG. 2 illustrates another view of an embodiment of a necktie apparatus covering a necktie.

FIG. 2 illustrates another view of the embodiment of a necktie apparatus 100 of FIG. 1 covering a necktie 120. The apparatus 100 is typically placed over the tie 120. In one implementation, the opening 106 is placed just under the knot 125 of the tie 120. The wearer then pulls the ends 115*a*, 115*b* of the drawstring 115 which pulls more of the length of the drawstring 115 from the hollow interior of the body 110. By pulling on the drawstring 115, the body 110 contracts as the drawstring 115 is drawn through the body 110, thereby decreasing the perimeter of the opening 106. The ends 115*a*, 115*b* of the drawstring 115 can either be crossed or not crossed over one another during operation. Once the opening 106 closed securely, the ends 115*a*, 115*b* can either be left to hang or be tied together. If the material of the bodies 105, 110 is rigid enough or has enough friction, the drawstring 115 may not have to be tied. In other embodiment, the apparatus 100 can further include fasteners that can secure the drawstring 115 after it is secured to the tie 120. It is typical to tie or secure the drawstrings in order to keep the apparatus 100 secured over the tie 120.

Figure 3:
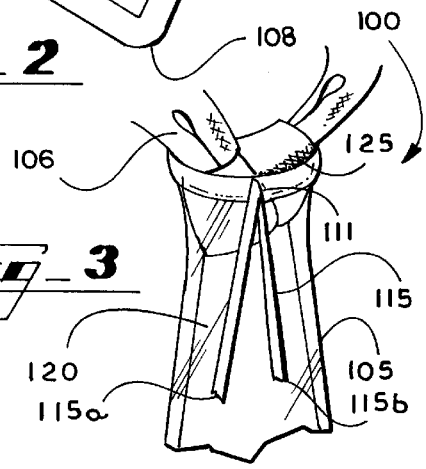
FIG. 3 illustrates a third view of an embodiment of a necktie apparatus covering a necktie; apparatus covering a necktie.

FIG. 3 illustrates a third view of the embodiment of the necktie apparatus 100 of FIGS. 1 and 2 covering a necktie 120. In this view, the opening 106 of the apparatus 100 has been placed higher on the tie 120 so that the body 110 is secured around the knot 125 when the drawstring 115 is drawn through the body 110. It is understood that the apparatus can be secured at any length along the tie 120 as desired by the wearer, although it is preferable to secure it at a location in the proximity of or on the knot 125.

Figure 4:
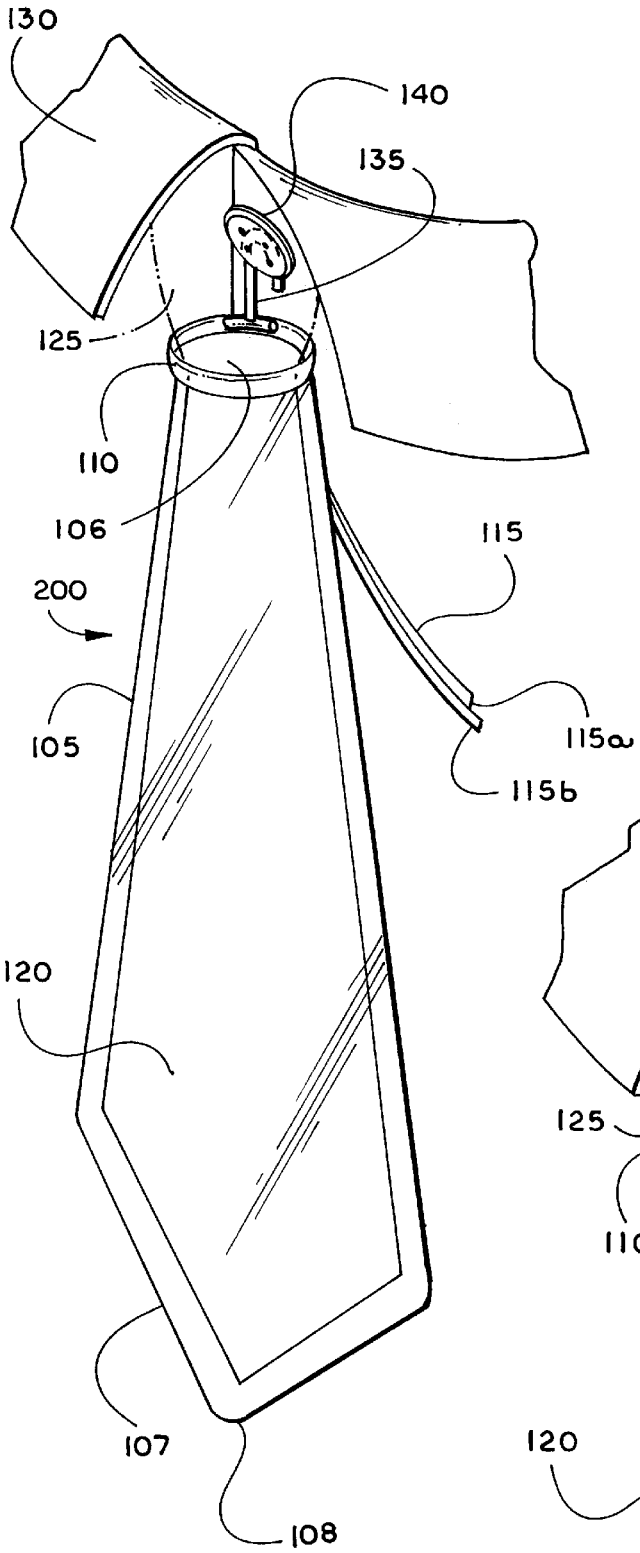
FIG. 4 illustrates a view of an alternate embodiment of a necktie apparatus covering a necktie and connected to a button of a shirt collar.

FIG. 4 illustrates a view of an alternate embodiment of a necktie apparatus 200 covering a necktie 120 and connected to a button 140 of a shirt collar 130. The apparatus 200 includes the body 105, having and open end 106 and closed end 107, the body 110 and the drawstring 115. The apparatus 200 further includes a hook 135 attached to the apparatus 200 typically connected to the body 110 near the opening 111 (not shown). The hook 135 can be attached to the button 140 of the wearers shirt near the shirt's collar 130. In this way, the apparatus 200 can be secured to the button 140 after it is placed over the tie 120. The drawstring 115 can then be drawn through the body 110. In this embodiment, the ends 15*a*, 115*b* of the drawstring 115 typically do not have to be any further secured or tied because they are not required to keep the apparatus 200 on the tie 120. The opening 111 (not shown) is positioned near the back if the tie 120. In this way the wearer pulls the drawstring 115 from the back of the tie 120. In another embodiment, as discussed above, the opening 111 can be in the front of the tie 120. Typically, the opening 111 and the drawstring 115 are in the back of the tie for a more aesthetic appearance. In addition, the hook 135 is not typically seen because it is behind the knot 125.

Figure 5:
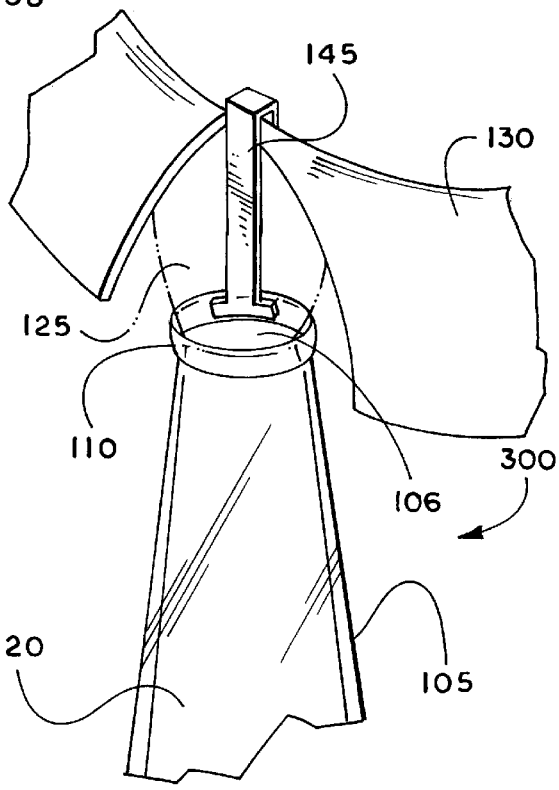
FIG. 5 illustrates a view of still another alternate embodiment of a necktie apparatus covering a necktie and connected to a shirt collar.

FIG. 5 illustrates a view of still another alternate embodiment of a necktie apparatus 300 covering a necktie 120 and connected to a shirt collar 130. The apparatus 300 includes the body 105, having and open end 106 and closed end 107, the body 110 and the drawstring 115 (not shown). The apparatus 200 further includes a hook 145 attached to the apparatus 300 typically connected to the body 110 near the opening 111 (not shown). The hook 145 can be attached to the collar 130 of the wearers shirt. In this way, the apparatus 300 can be secured to the collar 130 after it is placed over the tie 120. The drawstring 115 can then be drawn through the body 110. In this embodiment, the ends 115*a*, 115*b* of the drawstring 115 typically do not have to be any further secured or tied because they are not required to keep the apparatus 300 on the tie 120. The opening 111 (not shown) is positioned near the back if the tie 120. In this way the wearer pulls the drawstring 115 from the back of the tie 120. In another embodiment, as discussed above, the opening 111 can be in the front of the tie 120. Typically, the opening 111 and the drawstring 115 are in the back of the tie for a more aesthetic appearance. In addition, the hook 145 is not typically seen because it is behind the knot 125.

The embodiments of the necktie protection apparatus described above can be for a permanent apparatus or a disposable apparatus. A permanent apparatus is preferably durable and can easily be washed. The disposable apparatus can typically be an inexpensive sandwich bag-type material that can be obtained in bulk. The wearer can carry several of the disposable necktie protection apparatus and dispose of the apparatus after use.

Therefore, the foregoing is considered as illustrative only of the principles of the invention. Further, various modifications may be made of the invention without departing from the scope thereof and it is desired, therefore, that only such limitations shall be placed thereon as are imposed by the prior art and which are set forth in the appended claims.

What is claimed is:

1. A necktie protection apparatus, comprising:

an elongated tubular body having a hollow interior, the entire interior being enclosed, an open end, exposing a portion of the interior and a closed end, the open end generally defined by a perimeter;

a second tubular hollow body connected along the perimeter of the open end, the second tubular body having an opening in an outer surface; and a drawstring adapted to adjust the size of the open end of the elongated tubular body and located within the second hollow body, a length of the drawstring being enclosed by the second tubular body, wherein two ends of the drawstring protrude from the opening on the second tubular body.

2. The apparatus as claimed in claim 1, wherein the second hollow body is integral with the elongated hollow body.

3. The apparatus as claimed in claim 1, wherein the closed end of the elongated body tapers to a point.

4. The apparatus as claimed in claim 1, wherein the elongated body is clear flexible plastic.

5. The apparatus as claimed in claim 1, wherein the elongated body is cloth.

6. A necktie protection apparatus, comprising:

an elongated hollow body having an open end and a closed end, the open end generally defined by a perimeter;

a drawstring located within a second hollow body connected to the perimeter of the open end and enclosing a length of the drawstring, wherein the second hollow body includes an opening through which two ends of the drawstring protrude, wherein the drawstring is adapted to adjust the size of the open end; and a hook connected to the apparatus.

7. The apparatus as claimed in claim 6, wherein the hook is connected to the second hollow body near the opening on the perimeter.

8. The apparatus as claimed in claim 6, wherein the hook is connected to the second hollow body at a position along the perimeter farthest from the opening.

9. The apparatus as claimed in claim 6, wherein the hook is adapted to connect to a shirt.

10. The apparatus as claimed in claim 6, wherein the hook is adapted to connect to a button.

11. The apparatus as claimed in claim 6, wherein the hook is adapted to connect to a collar.

12. A necktie protection system, comprising:

a necktie;

a necktie protection apparatus, comprising:

an elongated tubular body having a hollow interior, the entire interior being enclosed, an open end, exposing a portion of the interior and a closed end, the open end generally defined by a perimeter;

a second tubular hollow body connected along the perimeter of the open end, the second tubular body having an opening in an outer surface; and a drawstring adapted to adjust the size of the open end of the elongated tubular body and located within the second hollow body, a length of the drawstring being enclosed by the second tubular body, wherein two ends of the drawstring protrude from the opening on the second tubular body.

13. The system as claimed in claim 12, wherein the necktie protection apparatus is clear plastic.

14. The system as claimed in claim 13, wherein the necktie protection apparatus is disposable.

15. A necktie protection system, comprising:

a necktie a necktie protection apparatus, comprising:

an elongated hollow body having an open end and a closed end, the open end generally defined by a perimeter;

a drawstring located within a second hollow body connected to the perimeter of the open end and enclosing a length of the drawstring, wherein the second hollow body includes an opening through which two ends of the drawstring protrude, wherein the drawstring is adapted to adjust the size of the open end; and a hook connected to the necktie protection apparatus, the hook adapted to connect to a shirt.

16. The system as claimed in claim 15, wherein the hook is adapted to connect to a shirt button.

17. The system as claimed in claim 15, wherein the hook is adapted to connect to a shirt collar.

* * * * *